United States Patent [19]

Frieder, Jr. et al.

[11] 4,345,338

[45] Aug. 24, 1982

[54] CUSTOM-FITTED HELMET AND METHOD OF MAKING SAME

[75] Inventors: Leonard P. Frieder, Jr., Dalton; Michael R. Lavender, Vandling, both of Pa.

[73] Assignee: Gentex Corporation, Carbondale, Pa.

[21] Appl. No.: 82,296

[22] Filed: Oct. 5, 1979

[51] Int. Cl.[3] ..... A42B 3/00; A42B 3/02

[52] U.S. Cl. ..... 2/414; 2/425

[58] Field of Search ..... 2/411, 412, 413, 414, 2/415, 425

[56] References Cited

U.S. PATENT DOCUMENTS

| | | | |
|---|---|---|---|
| 3,425,061 | 2/1969 | Webb | 2/414 |
| 3,882,546 | 5/1975 | Morton | 2/413 |
| 4,020,507 | 5/1977 | Morton | 2/411 |
| 4,075,717 | 2/1978 | Lemelson | 2/412 |
| 4,100,320 | 7/1978 | Chisum | 2/411 X |
| 4,133,055 | 1/1979 | Zebuhr | 2/411 |
| 4,134,155 | 1/1979 | Robertson | 2/412 |

FOREIGN PATENT DOCUMENTS

| | | | |
|---|---|---|---|
| 259489 | 6/1927 | Italy | 2/411 |

*Primary Examiner*—Louis Rimrodt

*Attorney, Agent, or Firm*—Shenier & O'Connor

[57] ABSTRACT

A custom-fitted helmet in which a preformed elastomer sack containing a resin-bead composite adapted to rigidify in response to mechanical deformation accommodates a single rigid outer shell to various individual head sizes. The underside of the sack is formed with circular channels concentric about the top of wearer's head which lockingly receive resilient strips that are part of a preformed inner helmet assembly. The resilient strips are carried on the inner assembly by intermediary energy-absorbing strips which are in turn adhered to a flexible leather liner fitting over the wearer's head.

3 Claims, 4 Drawing Figures

CUSTOM-FITTED HELMET AND METHOD OF MAKING SAME

BACKGROUND OF THE INVENTION

Protective helmets having hard outer shells for use in various military, industrial or other applications are well known in the art. In such helmets, it is generally desirable to provide a resilient liner assembly between the outer shell and the wearer's head to help absorb shock. While straps or similar elements have customarily been used in the past for this purpose, they must be adjustable to accommodate various head sizes, resulting in some wobbling from front to back or from side to side.

Various proposals for custom-fitted liner assemblies have been suggested in an attempt to overcome this defect. According to one known method of making a custom-fitted helmet, disclosed in Morton U.S. Pat. No. 3,882,546, the outer helmet shell is spaced a suitable distance from the wearer's head and foam is injected into the region between the outer shell and an elastic layer closely overlying the wearer's head. The necessity of directly handling the foaming agent limits the utility of this method in the field.

According to another method of making a custom-fitted helmet, disclosed in Chisum U.S. Pat. No. 4,100,320, the helmet liner is preformed with a plurality of adjacent pairs of cells respectively containing the first and second components of a foamable mixture. After the liner is placed between the helmet shell and the wearer's head, the cell partitions separating the first and second components are removed to initiate the foaming process. While this method avoids direct exposure to the liner foam, the complexity and hence expense of the preformed liner limit its practical application.

SUMMARY OF THE INVENTION

One of the objects of our invention is to provide a helmet assembly which allows an individual fit to a wearer's head.

Another object of our invention is to provide a helmet assembly which may be readily assembled in the field without requiring special equipment or specially trained personnel.

Another object of our invention is to provide a helmet assembly which affords good impact protection.

Other and further objects of our invention will be apparent from the following description.

In general, our invention contemplates a custom-fitted helmet in which a preformed elastomer sack containing a resin-bead composite adapted to rigidify in response to mechanical deformation accommodates a single rigid outer shell to various individual head sizes. The underside of the sack is preferably formed with circular channels concentric about the top of wearer's head which lockingly receive resilient strips that are part of a preformed inner helmet assembly. Preferably the resilient strips are carried on the inner assembly by intermediary energy-absorbing strips which are in turn adhered to a flexible leather liner fitting over the wearer's head.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENT

Figure 1:
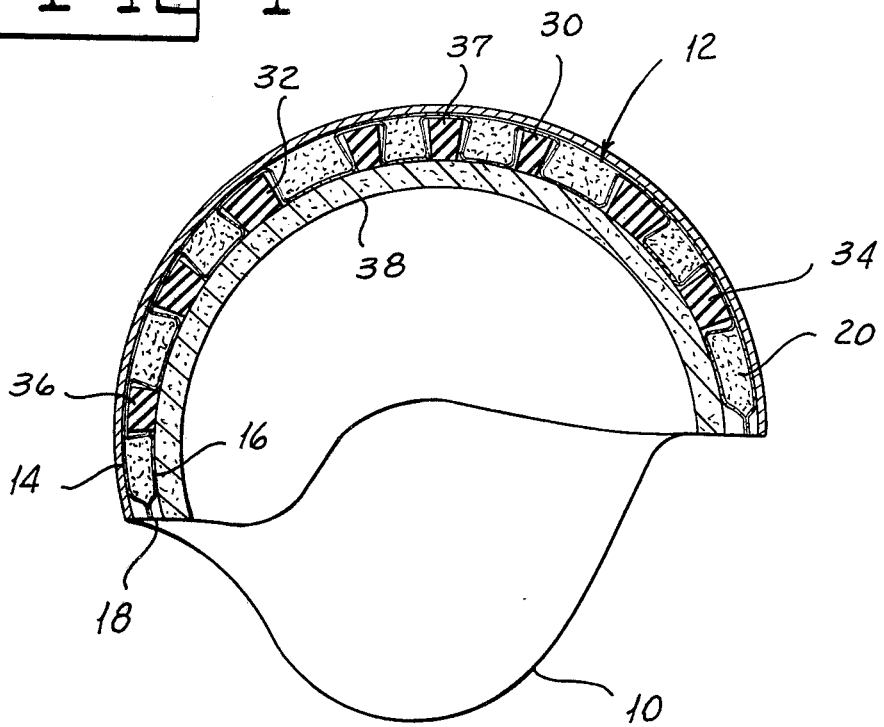
FIG. 1 is a sectional view of our helmet assembly in an intermediate stage of construction.

Referring now to the drawings, our helmet assembly is formed from a rigid outer shell 10, which may be of any suitable material known in the art having suitable ballistic properties. We adhere an elastomer sack or pouch 12 to the inner surface of shell 10 by any suitable adhesive. Sack 12 extends generally over the top of the wearer's head inside the shell 10. We form sack 12 from an inner sheet 16 and an outer sheet 14 of a suitable elastomeric material. Sheets 16 and 14 are heat-sealed around their common periphery 18, but are otherwise unconnected.

Sack 12 contains a resin-bead composite 20, the essential functional characteristic of which is that it rigidifies in response to pressure variations and frictional displacement. The resin used to form the composite may comprise the epoxy resin sold by Shell Chemical Co. under the trademark EPON. The beads are preferably styrene beads, but may also be formed from glass or other synthetic materials, and are preferably between 1/32 inch and $\frac{3}{8}$ inch in diameter. If desired, the sack 12 may be preformed in several different sizes such as small, medium and large to reduce the range of head sizes to be accommodated by an individual sack 12.

Figure 2:
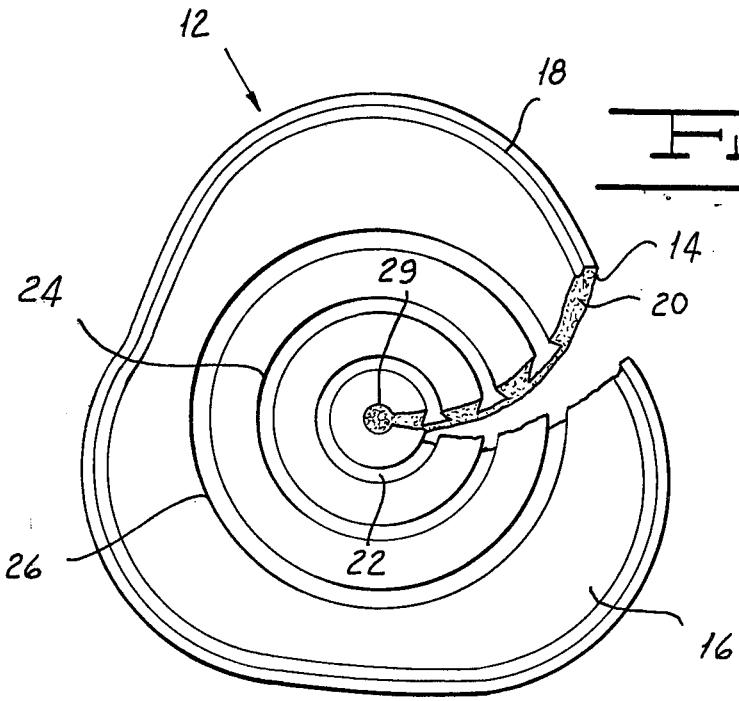
FIG. 2 is a bottom plan view of the elastomer sack used to form the helmet assembly shown in FIG. 1, shown partly in section.
Figure 3:
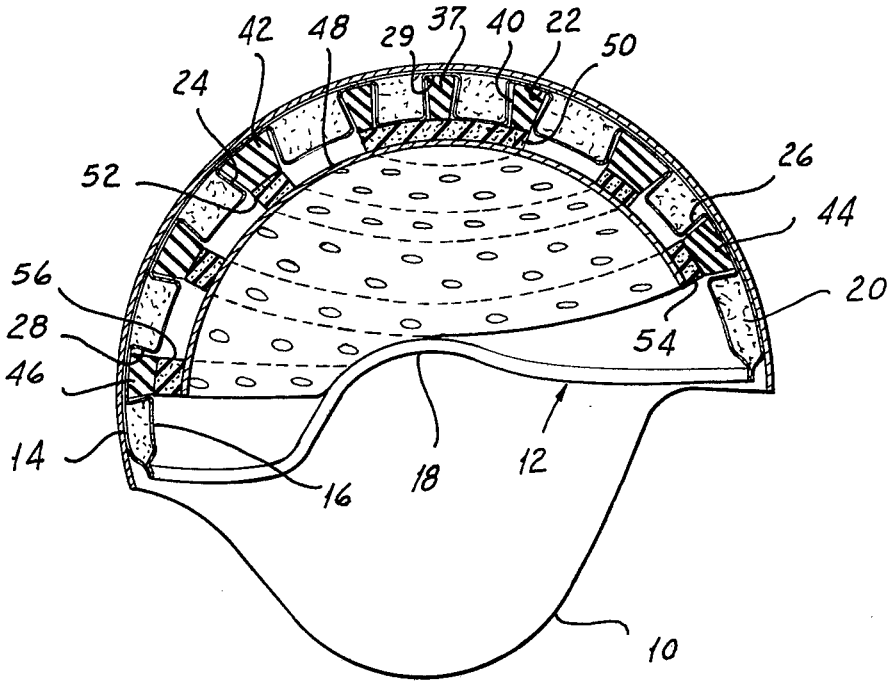
FIG. 3 is a sectional view of a completed version of the helmet assembly.
Figure 4:
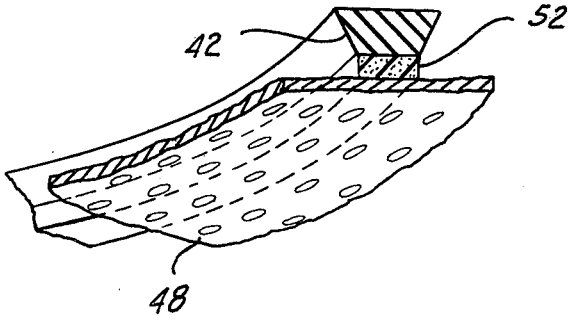
FIG. 4 is a fragmentary perspective view showing the relative placement of the impact-absorbing components of the helmet assembly shown in FIG. 3.

Inner sheet 16 of sack 12 is vacuum-formed with concentric circular channels or keyways 22, 24, 26 and 28 centered generally about the top of the wearer's head. Keyways 22, 24 and 26 extend all the way around inner sheet 16, while keyway 28 extends only around the rear portion of sheet 16 as shown in FIG. 3. Each of the keyways 22 to 28 is somewhat wider in the region adjacent outer sheet 14, as shown in FIGS. 2 and 3. In addition, inner sheet 16 is vacuum-formed with a conical frustum-shaped depression 29 of the same depth as keyways 22 to 28 and centered relative thereto.

To make a custom-fitted helmet according to our invention, an adhesive such as epoxy or the like is first applied to the inner surface of the shell 10. The sack 12 is kneaded for a few minutes as required to deform the enclosed resin mechanically and thus initiate the rigidification process. After the sack 12 has been kneaded a proper length of time, it is secured over the surface of outer sheet 14 to the inner surface of the shell 10 by the adhesive. Respective molding extrusions 30, 32, 34 and 36 preferably comprising rubber of approximately 60 Shore A hardness are inserted into the keyways 22, 24, 26 and 28 to maintain their shape during rigidification. A conical frustum-shaped plug 37 preferably comprising rubber of about 40 Shore A hardness is also inserted into depression 29 to maintain a predetermined spacing between the top of the shell 10 and the wearer's head.

Before the assembly of the sack 12 and shell 10 are applied to the wearer's head, we place a shell cap 38 over the head of the wearer. We make the cap 38 of any suitable material which is capable of deforming so as to conform to the shape of the wearer's head without being appreciably reduced in thickness. Preferably the cap 38 has approximately the same thickness as does the assembly of the helmet liner and energy-absorbing material to be described. Cap 38 further serves to shield the wearer's head from heat given off by the composite 20 as it solidifies. Next the sack 12 and shell 10 are placed as a unit over the wearer's head while the resin solidifies. The molding extrusions 30, 32, 34 and 36 serve to inhibit migration of the composite from the apex of sack 12 toward its perimeter as the composite solidifies. After solidification, these inserts 30, 32, 34 and 36 are removed.

Shell 10 and sack 12 are then fitted to a previously fabricated inner assembly comprising a leather liner 48 carrying on its outer, or convex, surface concentric circular patch 50 and strips 52, 54 and 56 of suitable crushable, energy-absorbing material such as polyurethane foam. Patch 50 and strips 52 to 56 in turn carry respective liner extrusions 40, 42, 44 and 46 preferably comprising rubber of approximately 40 Shore A hardness, somewhat softer than the molding extrusions 30 to 36. Any suitable adhesive such as an epoxy may be used to attach extrusions 40 to 46 respectively to elements 50 to 56. Elements 50 to 56 and extrusions 40 to 46 are so arranged that the extrusions fit readily into the keyways 22 to 28 of the elastomer sack 12.

Liner extrusions 40 to 46 are formed of a different, denser material from that used to form energy-absorbing elements 50 to 56 to optimize impact protection. During impact, energy from the impact should be distributed as uniformly over the wearer's head as possible. Even distribution of impact energy is dependent on the uniformity of elasticity of the medium absorbing the energy. By inserting in the keyways 22 to 28 a material which is more rigid than the energy-absorbing elements 50 to 56, yet flexible enough to squeeze into the keyways, the transition in elasticity between the sack 12 and the extrusions 40 to 46 is made more gradual and thereby more nearly approximating homogeneous elasticity.

It will be seen that we have accomplished the objects of our invention. Our helmet assembly provides an individual fit to a wearer's head as well as good impact protection without requiring special equipment or specially trained personnel. It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A custom-fitted helmet assembly including in combination a sealed elastomer sack having opposed convex and concave surface portions generally conforming to the top of a wearer's head and containing a rigidified resin composite, said resin composite having been rigidified in situ by placement of said sack over the wearer's head after mechanical deformation of said sack to initiate rigidification, a rigid outer shell secured to said convex surface portion of said sack, and an inner helmet assembly adapted to fit over the wearer's head, said sack being formed with recesses in said concave surface portion, said inner helmet assembly having resilient portions received by said recesses and energy-absorbing portions disposed between said resilient portions and the wearer's head.

2. A custom-fitted helmet assembly including in combination a sealed elastomer sack having opposed convex and concave surface portions generally conforming to the top of a wearer's head and containing a rigidified resin composite, said resin composite having been rigidified in situ by placement of said sack over the wearer's head after mechanical deformation of said sack to initiate rigidification, a rigid outer shell secured to said convex portion of said sack, and an inner helmet assembly adapted to fit over the wearer's head, said sack being formed with elongated channels in said concave surface portion generally concentrically disposed about the top of the wearer's head, said inner helmet assembly having portions received by said channels.

3. A custom-fitted helmet assembly including in combination a sealed elastomer sack having opposed convex and concave surface portions generally conforming to the top of a wearer's head and containing a rigidified resin composite, said resin composite having been rigidified in situ by placement of said sack over the wearer's head after mechanical deformation of said sack to initiate rigidification, a rigid outer shell secured to said convex portion of said sack, and an inner helmet assembly adapted to fit over the wearer's head, said sack and said inner assembly being formed with attachment portions engaging each other.

* * * * *